US005615887A

United States Patent [19]

Park

[11] Patent Number: 5,615,887

[45] Date of Patent: Apr. 1, 1997

[54] FLOATING WORD GAME IN A BODY OF WATER

[76] Inventor: Thomas W. Park, 408 Pearly Top, DeSoto, Tex. 75115

[21] Appl. No.: 677,446

[22] Filed: Jul. 2, 1996

[51] Int. Cl.[6] ..... A63F 9/00

[52] U.S. Cl. ..... 273/272; 446/153; 472/128

[58] Field of Search ..... 273/272, 411, 273/350, DIG. 2; 446/153, 220; 472/128; 434/159, 172

[56] References Cited

U.S. PATENT DOCUMENTS

| | | | |
|---|---|---|---|
| 3,107,095 | 10/1963 | Cairns | 446/153 |
| 3,251,600 | 5/1966 | Warnberg | 446/153 |
| 3,895,801 | 7/1975 | Baird | 273/350 |
| 4,690,410 | 9/1987 | Berton | 273/299 |
| 4,826,175 | 5/1989 | Quatrino | 273/299 |
| 4,923,199 | 5/1990 | Hahn | 273/299 |
| 4,966,366 | 10/1990 | Mercado-Torres | 434/172 |
| 5,328,173 | 7/1994 | Stern | 273/144 B |
| 5,536,009 | 7/1996 | Edwards | 446/153 |

*Primary Examiner*—William M. Pierce
*Attorney, Agent, or Firm*—Martin Korn

[57] ABSTRACT

A word game to be played in a body of water. The body of water has a surface, the game is played by two teams, each team having at least one player. The game includes the steps of positioning the players in the body of water. A plurality of gaming pieces is randomly distributed on the surface of the water. The gaming pieces have letters of the alphabet formed thereon. A word is identified. The players of each team collect gaming pieces to spell the identified word. The first team to have collected all gaming pieces to spell the identified word is the game winner.

6 Claims, 1 Drawing Sheet

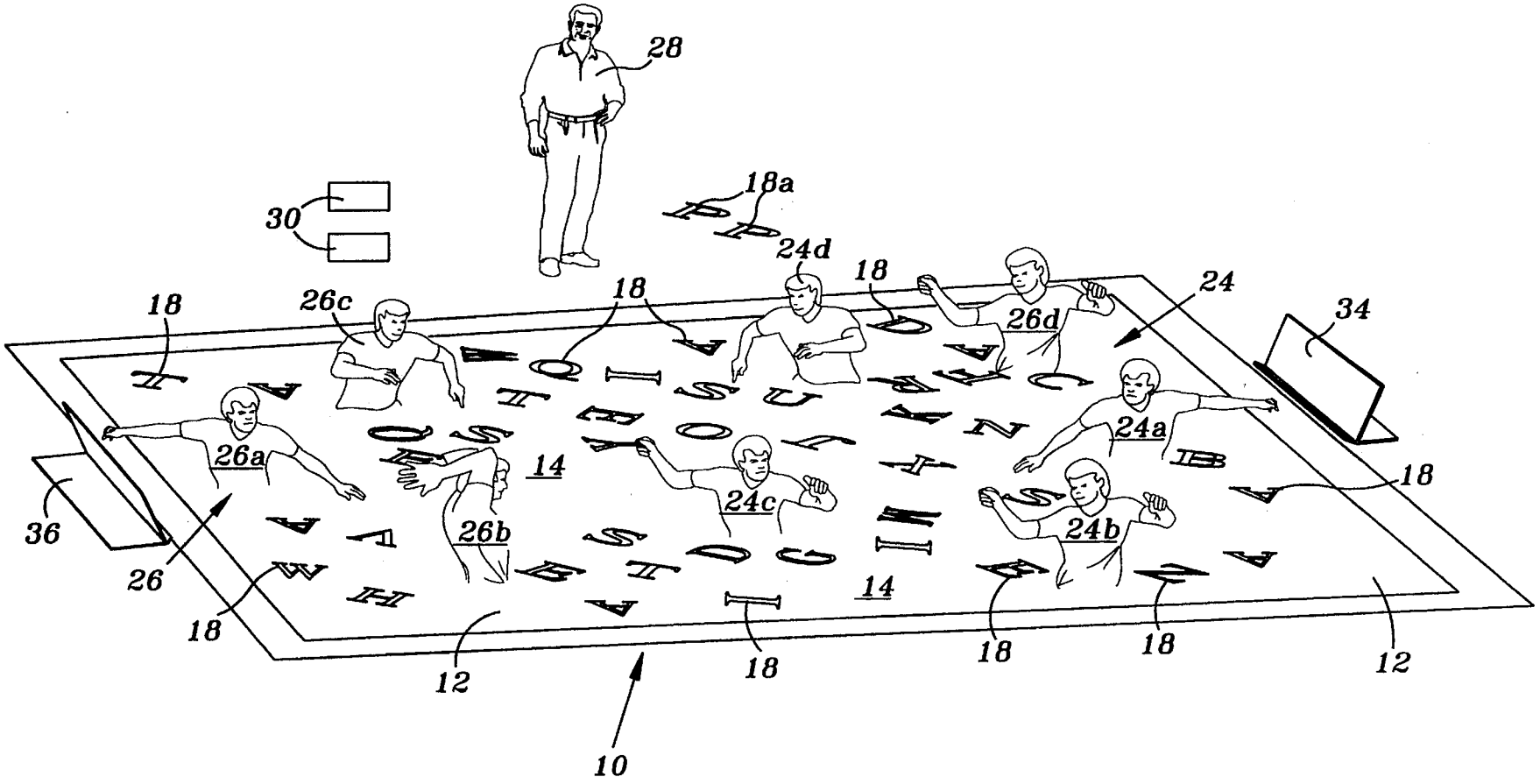
10
12
12
14
14
18
18a
24
24a
24b
24c
24d
26
26a
26b
26c
26d
28
30
34
36

FLOATING WORD GAME IN A BODY OF WATER

TECHNICAL FIELD OF THE INVENTION

The present invention relates to a word game, and more particularly to a word game played in a body of water.

BACKGROUND OF THE INVENTION

A variety of word games exists including those which use cubes with letters thereon, tiles, or cards. Generally, it is the purpose of these games to be entertaining and to be educationally challenging to the players. In addition, where the games may be used by children, games may have a positive effect helping the child to learn to spell. Typical games simply provide a player with a certain number of letters wherein each player uses those letters to form words. In some games, the player will draw from a draw pile or letter bank, to create a word. Such games provide limited intellectual stimulation and only involve slight strategy with regard to the selection, or arrangement of letters.

A need has thus arisen for a word game that is fun to play, physically challenging, and which maintains the interest of the players to provide an entertaining and educational game.

SUMMARY OF THE INVENTION

A word game to be played in a body of water is provided. The body of water has a surface, the game is played by two teams, each team having at least one player. The game includes the steps of positioning the players in the body of water. A plurality of gaming pieces is randomly distributed on the surface of the water. The gaming pieces have letters of the alphabet formed thereon. A word is identified. The players of each team collect gaming pieces to spell the identified word. The first team to have collected all gaming pieces to spell the identified word is the game winner.

BRIEF DESCRIPTION OF THE DRAWINGS

For a more complete understanding of the present invention and for further advantages thereof, reference is now made to the following Description of the Preferred Embodiments taken in conjunction with the accompanying Drawing which is a perspective view of players playing the present game.

DESCRIPTION OF THE PREFERRED EMBODIMENTS

Referring to the Figure, the present game is illustrated. The present game is designed for play in a body of water, such as, for example, a swimming pool, generally identified by the numeral 10. Although the Figure illustrates swimming pool 10 as the environment for the present game, the present game can be played in any type of body of water, such as, for example, a small pond, lake, stream or the like. Swimming pool 10 is shown for illustrative purposes only. Swimming pool 10 includes water 12 having a surface 14.

Disposed on surface 14 of water 12 are a plurality of gaming pieces 18. Gaming pieces 18 have letters of the alphabet formed thereon. Gaming pieces 18 may include tiles, cards, or the like, on which letters are printed or painted, or as illustrated in the Figure, may be shaped in the form of actual alphabetical letters. Gaming pieces 18 may be fabricated from plastic, Styrofoam, rubber, wood, or the like of sufficient density to float on surface 14 of water 12.

Gaming pieces 18 may include, for example, a total of 67 gaming pieces representing two pieces 18 for each consonant and five pieces 18 for each vowel of the alphabet. Gaming pieces 18 may be approximately five inches in length and one-quarter inch thick.

Disposed within swimming pool 10 are players 24 and 26. Four players 24*a*, 24*b*, and 24*c*, and 24*d* constitute one team. Players 26*a*, 26*b*, 26*c*, and 26*d* constitute a second team positioned within swimming pool 10. The number of players 24 and 26 is not critical to the play of the present game, four players being shown for illustrative purposes only. Players 24 and 26 randomly move about swimming pool 10. A player 24*a* and 26*a* may be designated as team captains. Gaming pieces 18 are readily available for collection by players 24 and 26 as gaming pieces 18 float on surface 14 of water 12.

One embodiment of the present game may include a referee 28 whose function will subsequently be described; however, referee 28 is not essential to play of the present game. Referee 28 may possess a plurality of cards 30 containing a selection of words to be used in playing the present game.

Disposed adjacent swimming pool 10 and accessible to players 24*a* and 26*a* are display racks 34 and 36 for display of gaming pieces 18.

The play of the game begins by players 24 and 26 positioned in opposed lines within swimming pool 10. All gaming pieces 18 are placed within swimming pool 10. If desired, a specific letter such as, for example, the letter "P" may be place outside of swimming pool 10. Gaming pieces 18*a* representing the letter "P" are positioned near referee 28. Team captains 24*a* and 26*a* are positioned adjacent their respective team's display racks 34 and 36. Referee 28 then selects a card 30 containing a word. Referee 28 provides word hints to both teams 24 and 26 until one of the teams guesses the word contained on the card. If a referee 28 is unavailable, any player 24 or 26 may select a card 30 and provide clues to teams 24 and 26 until the word is correctly guessed. Alternatively, a player 24 or 26 may merely select a card 30 and reveal the word. Additionally, if cards 30 are not used, a player 24 or 26 may merely call out a word.

Once a word is identified, players 24 and 26 must locate the letters in swimming pool 10 represented by gaming pieces 18 until the word has been properly spelled. As gaming pieces 18 are collected by players 24 and 26, the letters are passed to the team captain, 24*a* and 26*a*, to be placed on display racks 34 and 36. Game pieces 18 may be thrown or "passed" to a team captain 24*a* or 26*a* by their respective team mates. If a gaming pieces 18 is thrown and intercepted by an opposing team, the opposing team may use the letter to spell the identified word, or remove the letter from the game. Once the identified word has been completely spelled, and all gaming pieces 18 representing the letters of the identified word have been collected and placed within display racks 34 or 36, the game is complete. The team first spelling the word earns a point. Additionally, the team guessing the word correctly may earn a point. The complete game may consist of the spelling of, for example, sixteen words.

In the event that a gaming piece 18 such as, for example, gaming pieces 18*a* were placed outside pool 10, and if the identified word requires the gaming piece 18*a*, a player is required to get out of swimming pool 10, retrieve a gaming piece 18*a*, and cross back through swimming pool 10 across the opposing team side to place the gaming piece 18*a* in the respective team's display rack 34 or 36. Additional points may be awarded for use of gaming pieces 18*a* not disposed within swimming pool 10.

After each word has been completed, all gaming pieces 18 are then replaced into swimming pool 10 for subsequent games. Team members may rotate to provide different team captains periodically through the play of the entire game. Play of the game may also be varied by changing the location of players 24 and 26 within pool 10 to vary the water depth, and thereby create greater physical challenges.

In a simplified version of the present game, two opposing players may play against each other without a referee or team 24 or 26. One player merely identifying a word, and each player locating the appropriate gaming pieces 18 to spell the word, the first player collecting all letters is deemed the game winner.

In a further simplified version of the present game, the game may be played on the ground without the use of a swimming pool. Gaming pieces 18 are randomly placed on the surface of the ground and players 24 and 26 locate gaming pieces 18 in a manner as described above.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A method for playing a word game to be played in a body of water, the water having a surface, the game played by two teams, each team having at least one player, comprising the steps of:

providing a plurality of players and dividing them into two teams;

positioning the teams in a body of water, providing a plurality of gaming pieces and randomly distributing them on a surface of the body water, the gaming pieces having a letter of the alphabet formed thereon;

identifying a word; and players of each team moving within the body of water and among the gaming pieces in order to collect gaming pieces to spell the identified word, and declaring a winner to be the first team to have collected and arranged the collected gaming pieces to spell the identified word.

2. The method for playing a word game of claim 1 wherein the step of identifying a word includes:

one of the players selecting a word.

3. The method for playing a word game of claim 1 wherein the step of identifying a word includes:

a game referee providing clues by which the players guess a word.

4. The method for playing a word game of claim 1 and further including:

placing the collected gaming pieces in a rack disposed adjacent to the body of water after each gaming piece is collected.

5. The method for playing a word game of claim 1 and further including:

placing gaming pieces that represent a specific letter of the alphabet outside the body of water.

6. The method for playing a word game of claim 1 wherein the gaming pieces are shaped in the form of letters of the alphabet.

* * * * *